US005471718A

United States Patent [19]

Harrill

[11] Patent Number: 5,471,718

[45] Date of Patent: Dec. 5, 1995

[54] BURIAL VAULT

[76] Inventor: Donald R. Harrill, 122 Sherman Dr., Forest City, N.C. 28043

[21] Appl. No.: 185,459

[22] Filed: Jan. 25, 1994

[51] Int. Cl.[6] ..... A61G 17/00

[52] U.S. Cl. ..... 27/7; 27/14; 27/17; 220/669

[58] Field of Search ..... 27/2, 7, 6, 14, 27/17, 35; 220/306, 307, 669, 670, 671; 52/128

[56] References Cited

U.S. PATENT DOCUMENTS

| | | | |
|---|---|---|---|
| D. 161,561 | 1/1951 | Wickersham . | |
| D. 199,842 | 12/1964 | Neumann et al. . | |
| D. 222,880 | 1/1972 | Madlem . | |
| D. 300,978 | 5/1989 | Bethune et al. . | |
| D. 303,032 | 8/1989 | Clements . | |
| 1,199,325 | 9/1916 | Wallace . | |
| 1,785,156 | 12/1930 | Temple . | |
| 1,975,198 | 10/1934 | Doleman . | |
| 3,208,186 | 9/1965 | Fulton et al. . | |
| 3,439,461 | 4/1969 | Chandler et al. . | |
| 3,868,799 | 3/1975 | Hayward . | |
| 3,997,948 | 12/1976 | Hicks et al. . | |
| 4,253,220 | 3/1981 | Work . | |
| 4,288,952 | 9/1981 | Work . | |
| 4,315,353 | 2/1982 | Sorensen . | |
| 4,320,562 | 3/1982 | Kelley | 27/7 X |
| 4,872,586 | 10/1989 | Landis | 220/306 X |
| 4,881,658 | 11/1989 | VanCucha | 220/306 |
| 4,886,184 | 12/1989 | Chamourian | 220/306 |

*Primary Examiner*—Carl D. Friedman
*Assistant Examiner*—Kien T. Nguyen
*Attorney, Agent, or Firm*—Bell, Seltzer, Park & Gibson

[57] ABSTRACT

A burial vault formed of a polymeric material is disclosed. The burial vault includes a generally rectangular lower box portion and a generally rectangular upper lid portion. Each of the lid and box portions of the vault include substantially parallel lateral ribs integrally formed therein which are in alignment with and cooperate with one another to provide good strength and integrity to the vault. In addition, each of the lid and box portions include weight transferring and weight bearing ledges which assist in the strength of the vault. Fastening and sealing mechanisms are also disclosed which provide good barriers to penetration of air and water into the assembled vault.

11 Claims, 2 Drawing Sheets

BURIAL VAULT

FIELD OF THE INVENTION

This invention relates to a burial vault, and more particularly to burial vaults made of a polymeric material.

BACKGROUND OF THE INVENTION

For many years, it has been customary to position a burial vault in a grave and then place the casket within the burial vault. The vaults are sealed to prevent the entrance of air and water. In addition, the vaults should be structurally strong enough to support the weight of soil backfilled into the grave so that the vault, and not the casket, supports the weight of the soil.

To provide a vault having good structural integrity to support the weight of soil, vaults have been formed of a wide variety of materials. The construction of such vaults has included the use heavy wood, concrete, steel, and the like. Vaults formed of such materials can have adequate structural and tensile strength to resist the crushing force of the overlying earth load, as well as when it is subjected to the additional pressure of earth handling machinery moved thereover, as is common practice in cemetery operations. However, such vaults, particularly those formed of reinforced concrete, are heavy and can allow moisture to infiltrate through the porous concrete wall of the vault.

More recently synthetic materials such as fiberglass or plastics have been used to construct burial vaults. Such materials are impervious to air and water penetration. Vaults constructed entirely of synthetic materials, however, typically lack adequate structural, tensile and flexural strength and thus cannot withstand the crushing weight of the earth load and the weight of heavy equipment moved thereover.

Examples of prior attempts to provide a structurally sound and waterproof vault include U.S. Pat. No. 4,253,220 to Work. The Work patent discloses a molded plastic burial vault having a box and lid portions. Each of the box and lid portions include integrally formed ribs. The ribs are provided with corresponding tongue and groove portions that latch the box and lid together. In addition, the patent states that a pair of corresponding flanges having mutual tongue and grooves and a sealing compound placed therebetween to form a watertight seal.

U.S. Pat. No. 3,868,799 to Hayward discloses a burial vault having a cover and base portion which are held together by a plurality of lugs and notches to form a snaplock type latching mechanism. The vault includes integrally formed reinforcing ribs and a one-way seal that prohibits the passage of gasses and liquids into the vault while permitting the egress of gasses and liquids from the vault.

U.S. Pat. No. 4,315,353 discloses a plastic burial vault with a cover portion and a base portion. The cover portion has integrally formed ribs and is held to the base portion with threaded fasteners. A gasket between the cover and base seals the vault from the entrance of water.

Despite these and other burial vaults, it would be advantageous to provide a burial vault exhibiting improved structural strength and integrity. Further, it would advantageous to provide a burial vault which would optimize load transfer from the upper portion of the vault receiving the weight of backfilled soil to a lower portion thereof to prevent unnecessary and possibly debilitating pressure on fastening and sealing mechanisms thereof. It would be particularly desirable to provide such a structurally sound burial vault, which is also substantially air and water impervious and which can be easily and efficiently manufactured and assembled.

SUMMARY OF THE INVENTION

These and other advantages are provided by the polymeric vault of the present invention. The burial vault of the invention is formed of a polymeric material to provide a structure impervious to penetration by air and water. The vault includes a generally rectangular lower box portion having a base, opposing end walls, and opposing side walls. A generally rectangular upper lid portion, having a top, opposing end walls, and opposing side walls, is also provided which fits onto and engages the box portion to form the vault of the invention.

Each of the lid and box portions includes a plurality of lateral integrally formed support ribs. The ribs are formed so that the ribs of the upper lid and the lower box portions correspond and are in alignment with one another when the lid is placed onto the box. Thus weight applied to the lid can be effectively transferred from the lid to the box portion. This can be advantageous in minimizing or reducing weight and stress on the vault fastening and sealing mechanisms described below. This in turn can prevent disengagement of the fastening and sealing mechanisms and thus prevent breach of the impervious structure of the vault to air and water penetration.

The structural integrity of the burial vault is also reinforced by the cooperation of a weight transferring ledge and a weight bearing ledge, each integrally formed in the lid and box portions of the vault, respectively. Specifically, an outwardly extending peripheral weight bearing ledge is integrally formed along the upper edge of the side and end walls of the box, and an outwardly extending peripheral weight transferring ledge is integrally formed along the lower edge of the side and end walls of the lid. The ledges provide a support surface which when weight is placed on the upper surface of the lid of the vault can effectively transfer the weight from the lid to the box.

An integrally formed fastening mechanism is also provided for fastening the upper lid portion to the lower box portion of the vault. The fastening mechanism includes a first peripheral lip downwardly extending from a distal portion of the weight bearing ledge; a second peripheral lip downwardly extending from a distal portion of the weight transferring ledge and adapted to cover the outer surface of the first lip; and latch means associated with the second lip to engage the lip.

The burial vault can also include a channel extending about the upper surface of the weight bearing ledge which is adapted for receiving a sealing adhesive. In addition, for ease of lowering the vault into a grave, and for lowering a casket into the vault, the base of the box portion includes a plurality of upwardly extending substantially parallel transverse ribs integrally formed with the inner surface of the base. The ribs provide a clearance space between the bottom of the vault and a grave, and between the bottom of a casket lowered into the vault and the vault base. When lowering straps or other means are used to lower the vault in the grave, or the casket in the vault, the clearance space permits easy removal of the straps.

BRIEF DESCRIPTION OF THE DRAWINGS

In the drawings which form a portion of the original disclosure of the invention.

DETAILED DESCRIPTION OF THE INVENTION

The present invention will be now described more fully hereinafter with reference to the accompanying drawing, in which a preferred embodiment of the invention is shown. This invention can, however, be embodied in many different forms and should not be construed as limited to the embodiment set forth herein; rather, applicants provide this embodiment so that this disclosure will be thorough and complete, and will fully convey the scope of the invention to those skilled in the art. Like characters refer to like elements throughout.

Figure 1:
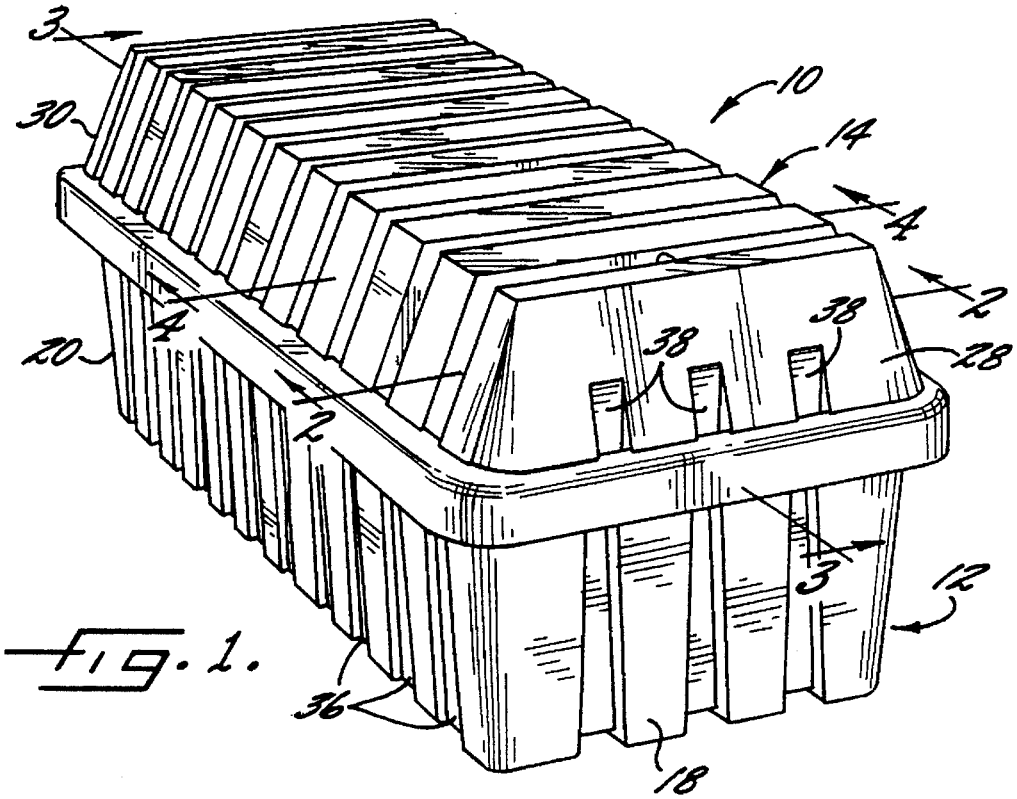
FIG. 1 is a top perspective view of a burial vault in accordance with the present invention.

FIG. 1 illustrates a top perspective view of a burial vault in accordance with the present invention, designated generally as 10. The burial vault 10 includes a generally rectangular lower box portion 12 and a corresponding generally rectangular upper lid portion 14. Both the lower box 12 and the upper lid 14 are formed of a polymeric material. Any of the polymeric materials known in the art for forming a burial vault can be used. Exemplary polymeric materials include polyolefins, such as polyethylene and polypropylene, polystyrene, polyamides, polyesters, vinyl polymers, fiber reinforced polymers, i.e., fiberglass, and the like. In a preferred embodiment, the polymeric burial vault is formed of a polyethylene material available from A. Schulman, Inc., Akron, Ohio, under the trade designation CP-812.

As illustrated in FIGS. 1–4, the lower box portion 12 of the polymeric burial vault includes a base 16, opposing end walls 18 and 20, and opposing side walls 22 and 24. The upper lid portion of the burial vault includes an upper wall or top 26, opposing end walls 28 and 30, and opposing side walls 32 and 34.

Both the lower box portion 12 and the upper lid portion 14 of the vault 10 include a plurality of integrally formed reinforcing ribs. Specifically, the lower box portion of the vault includes a plurality of substantially parallel lateral ribs 36 integrally formed with the inner surface of each of end walls 18 and 20 and side walls 22 and 24. Similarly, the upper lid portion of the vault includes a plurality of substantially parallel lateral ribs 38 also integrally formed with the inner surface of each of end walls 28 and 30 and side walls 32 and 34 of the upper lid portion. Ribs 36 and ribs 38 are formed in the walls of each of the lower and upper portions of the vault so that each of the ribs 38 of the lid is aligned with one of the ribs 36 of the box when the lid 14 is placed thereon.

The lateral ribs 36 and 38 provide good strength to the vault so that it can completely support the weight of backfilled soil. Because the lower edge of each the lateral ribs 38 of the upper lid portion 14 of the vault corresponds to and is in alignment with the upper edge of at least one of ribs 36 of the lower box portion 12, weight applied to the lid can be effectively transferred from the lid to the box portion. This can be advantageous in that the weight and stress on vault fastening and sealing mechanisms described in more detail below are minimized or reduced. This in turn can prevent disengagement of the fastening and sealing mechanisms and thus prevent breach of the impervious seal of the vault to air and water penetration. In addition, the ribs are formed so as to permit nested stacking of a plurality of lids or a plurality of boxes in storage.

The load transfer, and thus the structural integrity and strength of the vault of the invention, is further optimized by other structural features of the invention. For example, the lower box portion 12 and the upper lid portion 14 of the vault 10 terminate in a peripheral weight bearing ledge 40 and a peripheral weight transferring ledge 42, respectively. Ledges 40 and 42 are best illustrated in FIGS. 2, 4, 5 and 6.

Weight bearing ledge 40 is outwardly extending and is integrally formed with the upper edges of each of the opposing end walls 18 and 20, and opposing side walls 22 and 24, of the lower box portion 12. Similarly, each of the opposing end walls 22 and 24, and opposing side walls 26 and 28, of the upper lid portion of the vault have a corresponding outwardly extending weight transferring ledge 42 ledge formed integrally with the lower edges thereof. The structure of ledges 40 and 42, i.e., outwardly extending, and the position thereof, i.e., abutting, provide the mechanism for weight transfer.

Specifically, when weight, such as backfilled soil, is placed onto the lid portion of the vault, the weight is transferred from the lid to the ledge 42, which is supported by abutting ledge 40, and then transferred from ledge 42 to ledge 40. Because the ribs of both the upper and lower portions of the vault terminate in corresponding ledges 40 and 42, load transfer from the lid to the box is optimized. This also prevents unnecessary pressure on the fastening and sealing mechanisms of the vault.

Figure 2:
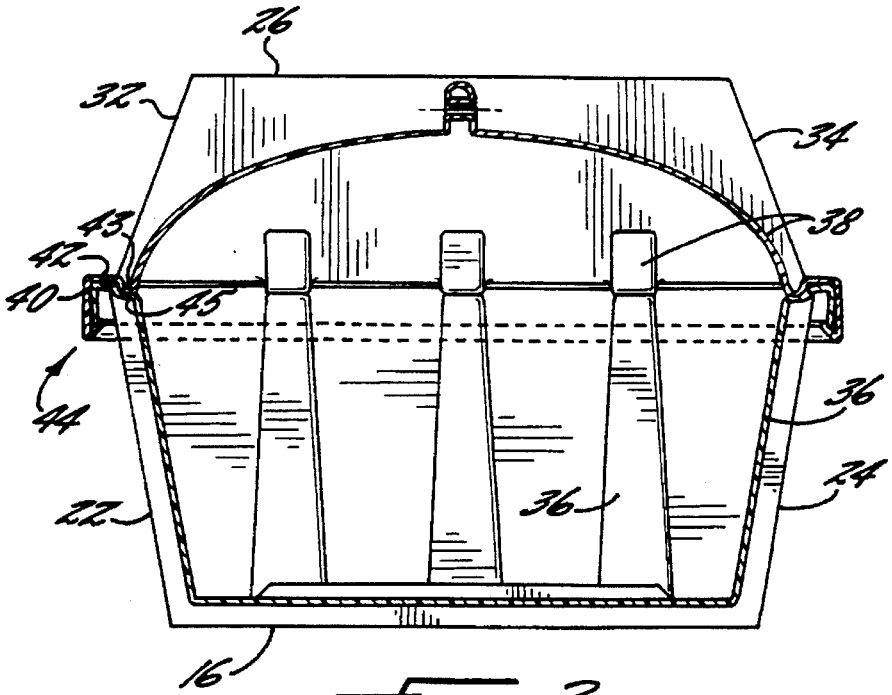
FIG. 2 is a cross sectional end view of the vault of FIG. 1 taken along line 2—2 and illustrates the structure of a spaced recess between ribs integrally formed in the walls of the vault.

Further, as best illustrated in FIG. 2, the lower portion of each of lateral ribs 38 adjacent the lower box 12 of the burial vault ends in an extension or hip 43. Each of hips 43 is integrally formed at the lower end of each rib 38 and extends below the weight transferring ledge 42, and thus below the perimeter seal which is formed between peripheral ledges 40 and 42. Each of hips 43 is in alignment with and is received by an upper portion 45 of a corresponding lateral rib 36. The plurality of hips 43 extending below ledge 42 and received by the upper portions of lower ribs 36 assist in aligning the side walls of the upper and lower portions 12 and 14 of the vault, and in preventing the upper and lower portions of the vault from slipping or otherwise becoming unaligned.

Figure 6:
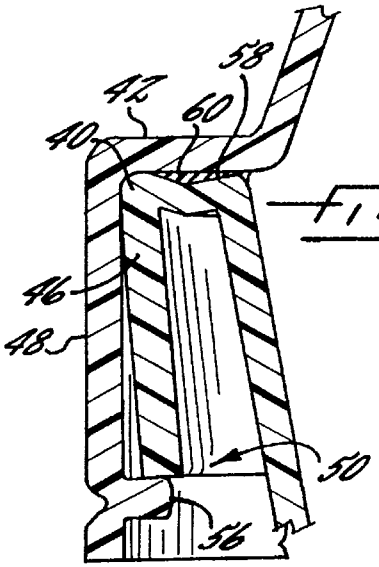
FIG. 6 is a greatly enlarged fragmentary sectional view of the side walls of the box and lid of the vault of the invention and illustrates another embodiment of a fastening mechanism therefore.
Figure 5:
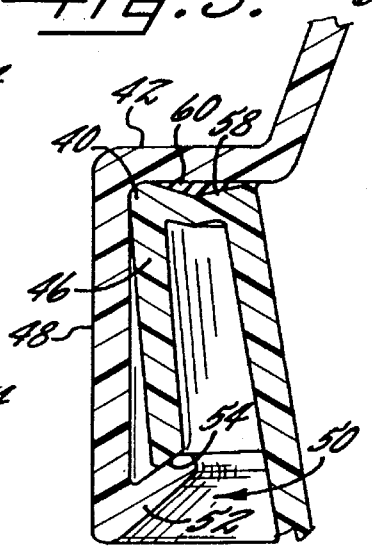
FIG. 5 is a greatly enlarged fragmentary sectional view of the side walls of the box and lid of the vault of the invention and illustrates one embodiment of a fastening mechanism therefore.
Figure 4:
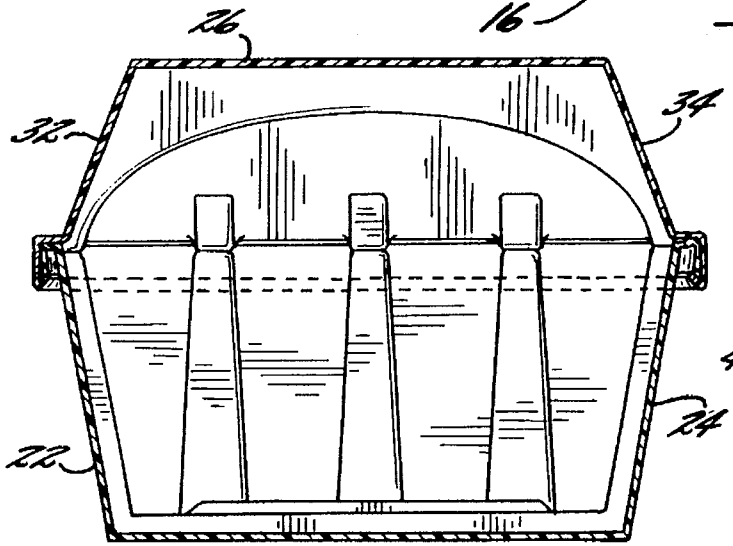
FIG. 4 is cross sectional side view of the vault of FIG. 1 taken along line 4—4 and illustrates the construction of a rib integrally formed in the wall of the vault.

Fastening means 44 secures together the upper and lower portions of the vault. Fastening means 44 is best illustrated in FIGS. 5 and 6. FIG. 5 is a greatly enlarged fragmentary sectional view of the side walls of the box and lid of the vault of the invention and illustrates one embodiment of a fastening mechanism therefore; FIG. 6 illustrates an alternative embodiment of the fastening mechanism. In both FIGS. 5 and 6, fastening means 44 includes a first peripheral lip 46 downwardly extending from a distal portion of the weight bearing ledge 40. A second peripheral lip 48 downwardly extending from a distal portion of weight transferring ledge 42 covers the outer surface of lip 46 of the box portion when the lid is placed onto the box.

To secure lip 48 to lip 46, a latch associated with a distal portion of the second lip 48, designated generally as 50 in FIGS. 5 and 6, engages first lip 46. Preferably, latch 50 comprises an inwardly extending member located along a lower distal portion of lip 48. The latch 50 forms a locking mechanism to secure the lid to the box of the vault.

For example, in the embodiment as illustrated in FIG. 5, latch 50 is an upwardly and inwardly extending member 52 integrally formed continuously along the distal peripheral edge of lip 48. When the lid portion 14 of the vault is aligned and placed onto the box portion 12 of the vault, a force is exerted downwardly onto the upper wall 26 of the lid portion until the lid is secured to the box. Specifically, when the downward force is exerted, the lid moves downwardly so that lip 48 slides downwardly and covers the outer surface of lip 46. The lid is slid downwardly until member 52 engages or "snaps" about a lower edge 54 of lip 46 in a snaplock connection.

An alternative embodiment of latch 50 of the invention is illustrated in FIG. 6. As indicated in FIG. 6, latch 50 comprises a plurality of discontinuous inwardly extending members or protrusions 56 formed during fastening of the upper lid portion 14 to the lower box portion 12. When the lid portion of the vault is aligned and placed onto the box portion of the vault, a downward force is exerted onto the upper wall 26 of the lid portion as described above so that the lid moves downwardly until lip covers the outer surface of lip 46. Thereafter, in this embodiment, an additional force is exerted inwardly along a lower outer portion of lip 48 so that an inwardly projecting thimble-like protrusion 56 snaps over the lower edge 54 of lip 46, thus engaging a lower portion thereof.

The additional force is repeated at a plurality of discrete individual locations about the outer periphery of said lip 48. This results in the formation of a plurality of individual protrusions 56 at spaced apart locations thereon. Preferably, each additional force is applied at a separate discrete location along the outer surface of lip 48, each of the discrete locations being in alignment with ribs 36 and 38.

In addition to fastening means 44 described above, a sealing mechanism is also provided to further protect against penetration of air and water into the vault of the invention. As with the fastening mechanism of the invention, the sealing mechanism is best illustrated in FIGS. 5 and 6. Specifically, the sealing mechanism of the invention includes a channel 58 extending about the upper surface of weight bearing ledge 40. The channel 58 is integrally formed in the ledge along the upper edge of side walls and end walls of lower box portion 12.

Channel 58 has a depth sufficient to receive a sealing agent 60 for sealing upper lid portion 14 to the lower box portion 14 of the vault. Any of the sealing agents known in the art for providing a seal against air and water penetration can be used. Exemplary sealing agents include butyl rubbers, i.e., copolymers of isobutylene and isoprene, epoxy resins, and the like. A preferred sealing agent is a compounded extruded butyl rubber mixture strip sealant available from Greenwood Plastics of Danville, Ill.

Figure 3:
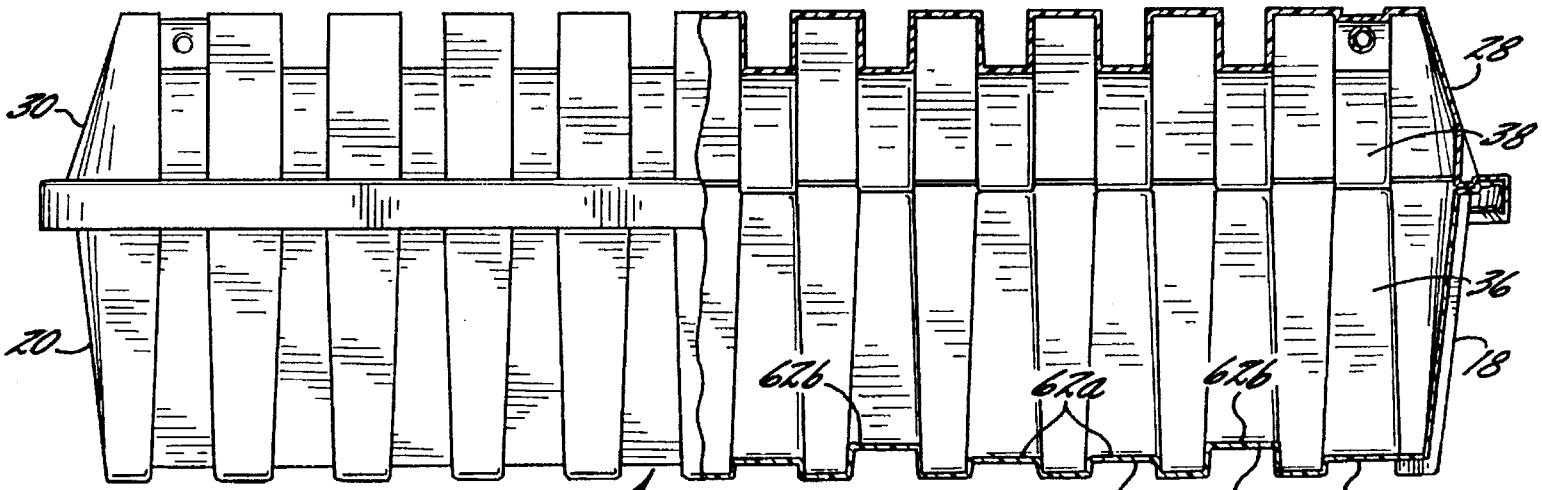
FIG. 3 is a partial cross sectional side view of the burial vault of FIG. 1 taken along line 3—3 and illustrates the structure of upwardly extending integrally formed ribs in the base of the burial vault.

As illustrated in FIG. 3, the burial vault of the invention also includes a plurality of upwardly extending substantially parallel transverse ribs 62 integrally formed with the inner surface of the base 16 of the lower box portion. Providing upwardly extending ribs in the base of the box portion of the vault is advantageous when lowering the vault into a grave site. Typically, a vault would be lowered into the grave using straps placed about the outer periphery thereof. The height of the ribs is sufficient to prevent the straps from being pinched between the lower surface of the vault and the bottom surface of the grave so that the straps can be easily removed after the vault has been fully lowered.

Preferably, the upwardly extending substantially parallel transverse ribs 62 are of different heights so that some of the ribs extend a greater distance upwardly from the base than do others of the ribs. The height difference is illustrated in FIG. 3, wherein ribs having a lower height are indicated by the designation **62*a* and ribs having a greater height are designated as 62*b*. Providing upwardly extending ribs of different heights is particularly advantageous when lowering a casket within the vault. A casket placed within the vault will rest on the upper surface of the higher ribs 62*b***. Thus the casket contacts the vault along these ribs only so that the lowering straps used to place the casket in the vault can be easily removed.

The vaults of the present invention can be easily and efficiently produced using standard techniques known in the art for manufacturing molded polymeric products. As previously discussed, the box portion 12 and the lid portion 14 of the vault are made so that the structural components thereof, i.e., the plurality of substantially parallel integral lateral ribs 36 and 38, are in alignment with one another when the lid is placed onto and secured to the box. This can be accomplished by rotormold or injection molding of the lid and box portions. The lid and box portions of the vault can also be formed by casting the units on appropriate molds from plastic materials amenable to such casting techniques.

The invention has been described in considerable detail with reference to its preferred embodiments. It will be apparent that numerous variations and modifications can be made without departing from the spirit and scope of the invention as described in the foregoing detailed specification and as defined in the following claims.

That which is claimed is:

1. A burial vault formed of a polymeric material comprising:

a generally rectangular lower box portion having a base, opposing end walls each having inner and outer surfaces, and opposing side walls each having inner and outer surfaces;

a generally rectangular upper lid portion having a top, opposing end walls each having inner and outer surfaces, and opposing side walls each having inner and outer surfaces;

a plurality of substantially parallel lateral ribs integrally formed with the inner surface of each of said end walls and said side walls of said lower box portion so as to form corresponding recesses in the respective outer surfaces;

a plurality of substantially parallel lateral ribs integrally formed with the inner surface of each of said end walls and said side walls of said upper lid portion so as to form corresponding recesses in the outer surfaces and aligned with and supported by said ribs of said lower box portion;

an outwardly extending peripheral weight bearing ledge integrally formed along the upper edge of said side walls and said end walls of said lower box portion;

an outwardly extending peripheral weight transferring ledge integrally formed along the lower edge of said side walls and said end walls of said upper lid portion; and fastening means for fastening said upper lid portion to said lower box portion, comprising:

a first peripheral lip downwardly extending from a distal portion of said weight bearing ledge;

a second peripheral lip downwardly extending from a distal portion of said weight transferring ledge and adapted to cover the outer surface of said first lip; and at least one member extending inwardly from said second lip to engage said first lip of said lower box portion.

2. The burial vault of claim 1 wherein said inwardly extending member is located along a distal portion of said second lip and engages said first lip.

3. The burial vault of claim 2 wherein said inwardly extending member is integrally formed along a distal peripheral edge of said second lip and engages a distal edge of said first lip in a snaplock connection.

4. The burial vault of claim 1 wherein said at least one inwardly extending member further comprises a plurality of inwardly extending members formed during fastening of said upper lid portion to said lower box portion, each of said members being located at discrete locations along a peripheral distal portion of said second lip and engaging a distal portion of said first lip.

5. The burial vault of claim 1 wherein said base of said lower box portion includes a plurality of upwardly extending substantially parallel transverse ribs integrally formed with the inner surface of said base so as to form corresponding recesses in the outer surface of said base.

6. The burial vault of claim 1 further comprising a channel extending about the upper surface of said weight bearing ledge integrally formed therein.

7. The burial vault of claim 6 wherein said channel is adapted for receiving sealing means for sealing said upper lid portion to said lower box portion.

8. The burial vault of claim 1 wherein said vault is formed of polyethylene.

9. A burial vault formed of a polymeric material comprising:

a generally rectangular lower box portion having a base, opposing end walls each having an inner surface, and opposing side walls each having an inner surface;

a generally rectangular upper lid portion having a top, opposing end walls each having an inner surface, and opposing side walls each having an inner surface;

a plurality of substantially parallel lateral ribs integrally formed with the inner surface of each of said end walls and said side walls of said lower box portion;

a plurality of substantially parallel lateral ribs integrally formed with the inner surface of each of said end walls and said side walls of said upper lid portion adapted to be in alignment with said ribs of said lower box portion;

an outwardly extending peripheral weight bearing ledge integrally formed along the upper edge of said side walls and said end walls of said lower box portion;

an outwardly extending peripheral weight transferring ledge integrally formed along the lower edge of said side walls and said end walls of said upper lid portion;

fastening means for fastening said upper lid portion to said lower box portion, comprising:

a first peripheral lip downwardly extending from a distal portion of said weight bearing ledge;

a second peripheral lip downwardly extending from a distal portion of said weight transferring ledge and adapted to cover the outer surface of said first lip; and latch means associated with said second lip to engage said first lip of said lower box portion;

wherein said base of said lower box portion includes a plurality of upwardly extending substantially parallel transverse ribs integrally formed with the inner surface of said base; and wherein said upwardly extending substantially parallel transverse ribs include a first set of ribs extending a first distance upward from said base, and a second set of ribs extending a second distance upward from said base, said second distance being greater than said first distance.

10. The burial vault of claim 9 wherein said second set of upwardly extending substantially parallel transverse ribs are adapted for supporting a casket placed thereon.

11. A burial vault formed of a polymeric material comprising:

a generally rectangular lower box portion having a base, opposing end walls each having an inner surface, and opposing side walls each having an inner surface;

a generally rectangular upper lid portion having a top, opposing end walls each having an inner surface, and opposing side walls each having an inner surface;

a plurality of substantially parallel lateral ribs integrally formed with the inner surface of each of said end walls and said side walls of said lower box portion;

a plurality of substantially parallel lateral ribs integrally formed with the inner surface of each of said end walls and said side walls of said upper lid portion aligned with and supported by said ribs of said lower box portion;

an outwardly extending peripheral weight bearing ledge integrally formed along the upper edge of said side walls and said end walls of said lower box portion;

an outwardly extending peripheral weight transferring ledge integrally formed along the lower edge of said side walls and said end walls of said upper lid portion; and fastening means for fastening said upper lid portion to said lower box portion, comprising:

a first peripheral lip downwardly extending from a distal portion of said weight bearing ledge;

a second peripheral lip downwardly extending from a distal portion of said weight transferring ledge and adapted to cover the outer surface of said first lip; and latch means associated with said second lip to engage said first lip of said lower box portion;

a plurality of upwardly extending substantially parallel transverse ribs integrally formed with the inner surface of said base; and a channel extending about the upper surface of said weight bearing ledge integrally formed in said ledge along the upper edge of said side walls and said end walls of said lower box portion, adapted for receiving sealing means for sealing said upper lid portion to said lower box portion.

* * * * *